US006653771B2

(12) United States Patent
Ishihara et al.

(10) Patent No.: US 6,653,771 B2
(45) Date of Patent: Nov. 25, 2003

(54) ELECTRON GUN ASSEMBLY AND CATHODE RAY TUBE APPARATUS

(75) Inventors: Tomonari Ishihara, Fukaya (JP); Kazunori Satou, Fukaya (JP); Hirofumi Ueno, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 160 days.

(21) Appl. No.: 09/933,840

(22) Filed: Aug. 22, 2001

(65) Prior Publication Data

US 2002/0024285 A1 Feb. 28, 2002

(30) Foreign Application Priority Data

| | | |
|---|---|---|
| Aug. 23, 2000 | (JP) | 2000-252781 |
| Dec. 8, 2000 | (JP) | 2000-374621 |
| Jul. 10, 2001 | (JP) | 2001-209735 |

(51) Int. Cl.[7] ..... H01J 29/50; H01J 1/20; H01J 29/04

(52) U.S. Cl. ..... 313/414; 313/310; 313/311; 313/346 R; 313/412; 313/441; 313/446

(58) Field of Search ..... 313/310, 311, 313/346 R, 412, 414, 416, 441, 446

(56) References Cited

U.S. PATENT DOCUMENTS

| | | | | |
|---|---|---|---|---|
| 4,513,222 A | * | 4/1985 | Chen | 313/412 |
| 6,031,326 A | * | 2/2000 | Suzuki et al. | 313/414 |

FOREIGN PATENT DOCUMENTS

| | | |
|---|---|---|
| JP | 11-120931 | 4/1999 |
| JP | 11-283487 | 10/1999 |

* cited by examiner

*Primary Examiner*—Nimeshkumar D. Patel
*Assistant Examiner*—Sharlene Leurig
(74) *Attorney, Agent, or Firm*—Oblon, Spivak, McClelland, Maier & Neustadt, P.C.

(57) ABSTRACT

The electron beam generating section in an electron gun assembly includes a cathode having an electron emitting surface. The surface of the cathode is divided into at least three regions of first, second and third regions which have different electron emission capabilities. The first region is arranged in the center of the surface of the cathode. The second region has its portions arranged on opposite sides of the first region in the horizontal direction. The third region has its portions arranged on opposite sides of the first region in the vertical direction.

16 Claims, 7 Drawing Sheets

ELECTRON GUN ASSEMBLY AND CATHODE RAY TUBE APPARATUS

CROSS-REFERENCE TO RELATED APPLICATIONS

This application is based upon and claims the benefit of priority from the prior Japanese Patent Applications No. 2000-252781, filed Aug. 23, 2000; No. 2000-374621, filed Dec. 8, 2000; and No. 2001-209735, filed Jul. 10, 2001, the entire contents of all of which are incorporated herein by reference.

BACKGROUND OF THE INVENTION

1. Field of the Invention

The present invention relates to an electron gun assembly and more specifically to the structure of cathodes built in the electron gun assembly.

2. Description of the Related Art

An electron gun assembly used in general color cathode ray tubes comprises an electron beam generating section for generating three electron beams from cathodes arranged in a horizontal direction and a main lens section for accelerating the three electron beams and focusing them onto the phosphor screen. The electron beam generating section is constructed from at least three cathodes, a first electrode, and a second electrode. The cathodes are supplied with drive voltages synchronized with a video signal. The intensity of the electron beams (currents) emitted from the cathodes is controlled by the drive voltages.

One of visual characteristics required of color cathode ray tubes is that the picture quality is little subject to variation regardless of the intensity of electron beams (currents).

In general, increasing the beam current, i.e., increasing the electron beam intensity, causes the size of beam spots on the phosphor screen to be increased. This increase in the spot size causes the picture quality to deteriorate. One way to improve the deterioration in picture quality resulting from the increased spot size is to reduce the apparent spot size through the use of a commonly used velocity modulation coil (hereinafter referred to as a VM coil).

The VM coil is mounted externally around the neck of the tube. The VM coil is supplied with currents in synchronization with the rise and fall of a brightness signal so as to produce a very small deflection of the beams fast at the rise of the brightness signal but slow at the fall. As a consequence, the picture contrast is increased at the rise and fall of the brightness signal and the apparent spot size is reduced.

The current flowing in the VM coil depends on the magnitude of the drive voltage. At low beam currents, i.e., when the electron beam intensity is low, the current in the VM coil is also low, in which case the spot size little varies in the horizontal direction. On the other hand, for high beam currents, i.e., when the electron beam intensity is high, a high current flows in the VM coil, which results in a significant reduction in the spot size in the horizontal direction. The spot size is reduced only in the direction of deflection of electron beams by the deflection yoke, i.e., in the horizontal direction. The spot size in the vertical direction is not reduced. That is, an increase in the spot size in the vertical direction resulting from an increase in cathode current cannot be controlled.

Here, a description is given of the reason why an increase in the cathode current results in an increase in the spot size.

To increase the beam current from the cathode, the drive voltage to the cathode is increased. By so doing, the potential penetration is increased, so that the electron loading area in the cathode surface expands. As a result, the number of electrons emitted from the cathode (current) increases. An increase in the beam current and an expansion in the electron loading area cause the size of a virtual object point relative to the main lens to increase, resulting in the increased spot size on the phosphor screen.

With increasing beam current, the angle of divergence of an electron beam will also increase, causing the position of the virtual object point (the position of the object point which is seen by the main lens) to shift toward the phosphor screen. The forward shifting of the virtual object point changes the focusing voltage which keeps the electron beam spot in focus on the phosphor screen.

In general, the focusing voltage for video signals is constant. With increasing beam current, the beam spot on the phosphor screen becomes defocused gradually and the spot size increases.

With increase in the beam current, the space charges repelling effect at the crossover point of electron beam is enhanced, causing the size of the virtual object point to be increased and the virtual object point to shift toward the screen. As a result, the spot is increased in size as described previously.

Thus, when the beam current changes from a low value to a high value, the spot size on the phosphor screen increases, causing a degradation in picture definition.

One way to reduce the spot size at high beam currents is to reduce the diameter of the first electrode to thereby reduce the size of the virtual object point. However, this approach, while allowing the spot size at high beam currents to be reduced, cannot control variations in the spot size due to beam current variations. That is, this approach not only reduces the spot size at high beam currents but also reduces the spot size at low beam currents excessively. This may produce a degradation in picture quality, such as moire.

That is, with the way to reduce the diameter of the first electrode, it is impossible to control variations in the spot size due to beam current variations.

In Japanese Patent Application KOKAI Publications Nos. 11-120931 and 11-283487, there are disclosed techniques by which the electron loading area is restricted according to beam current variations to thereby control an increase in the spot size at high beam currents. According to these techniques, the cathode is formed with a core emitter in the center of its surface, a non-emission region around the core emitter, and a circumferential emitter around the non-emission region. The circumferential emitter is only left from a manufactural point of view and in practice it does not contribute to the emission of electrons.

Another cathode structure is such that there are provided a region suitable for emitting electrons in the center of the cathode surface (a region low in work function) and a region not suitable for emitting electrons around the center region (a region high in work function).

Those publications describe that good picture quality can be obtained by restricting the electron loading area to the center of the cathode surface, reducing the amount of circumferential beams containing many aberration components, and forming beam spots with little halo. With this method, however, the electron emission capability of the cathode is significantly degraded at high beam current time and, in producing a high beam current, the drive voltage has to be set considerably higher than usual. This increases the burden on drive circuitry, which leads to an increase in the cost of the drive circuitry and a reduction in the reliability of the drive circuitry.

As described above, in order to provide good picture quality, it is required to make the spot size on the phosphor screen little vary with varying beam current. Optimization of the sensitivity of the VM coil allows an increase in the spot size in the horizontal direction when the beam current changes from a low value to a high value to be compensated for. However, an increase in the spot size in the vertical direction cannot be compensated for. Such problems cannot also be solved by making the electron beam generating section smaller in size. That is, with the conventional methods, it is difficult to optimize the spot size in both the horizontal and vertical directions regardless of the beam current variations.

With the method in which the electron loading area is restricted to the center of the cathode, it is possible to suppress an increase in the spot size when the beam current changes from a low value to a high value, but the drive voltage has to be increased significantly, which increases the burden on drive circuitry, increases the cost thereof, and reduces the reliability thereof.

BRIEF SUMMARY OF THE INVENTION

It is therefore an object of the present invention to provide an electron gun assembly and a cathode ray tube equipped with the gun assembly can be provided which allow an increase in the burden on drive circuitry to be controlled, an increase in the beam spot size in the horizontal and vertical directions on the phosphor screen with increasing beam current to be controlled, and high definition to be obtained.

According to an aspect of the present invention there is provided an electron gun assembly having an electron beam generating section which generates an electron beam and a main lens which accelerates the electron beam and focus it onto a target, wherein the electron beam generating section includes a cathode having an electron emitting surface and the surface of the cathode is divided into at least three regions of first, second and third regions which are different in electron emission capability, the first region being arranged in the center of the surface of the cathode, the second region being arranged on opposite sides of the first region in a first direction, and the third region being arranged on opposite sides of the first region in a second direction.

According to another aspect of the present invention there is provided a cathode ray tube apparatus including an electron gun assembly having an electron beam generating section which generates three electron beams in a horizontal direction and a main lens which accelerates the electron beams and focus them onto a phosphor screen, deflection yoke which deflects the three electron beams to scan across the phosphor screen in the horizontal and vertical directions, and velocity modulation coil which modulates the velocity of the electron beams, wherein the electron beam generating section includes three horizontally aligned cathodes and each having an electron emitting surface, a first electrode, and a second electrode which are arranged in this order in the direction in which the electron beams travel, and the surface of each of the cathodes is divided into at least three regions of first, second and third regions which have different electron emission capabilities, the first region being arranged in the center of the surface of the cathode, the second region being arranged on opposite sides of the first region in the horizontal direction, and the third region being arranged on opposite sides of the first region in the vertical direction.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
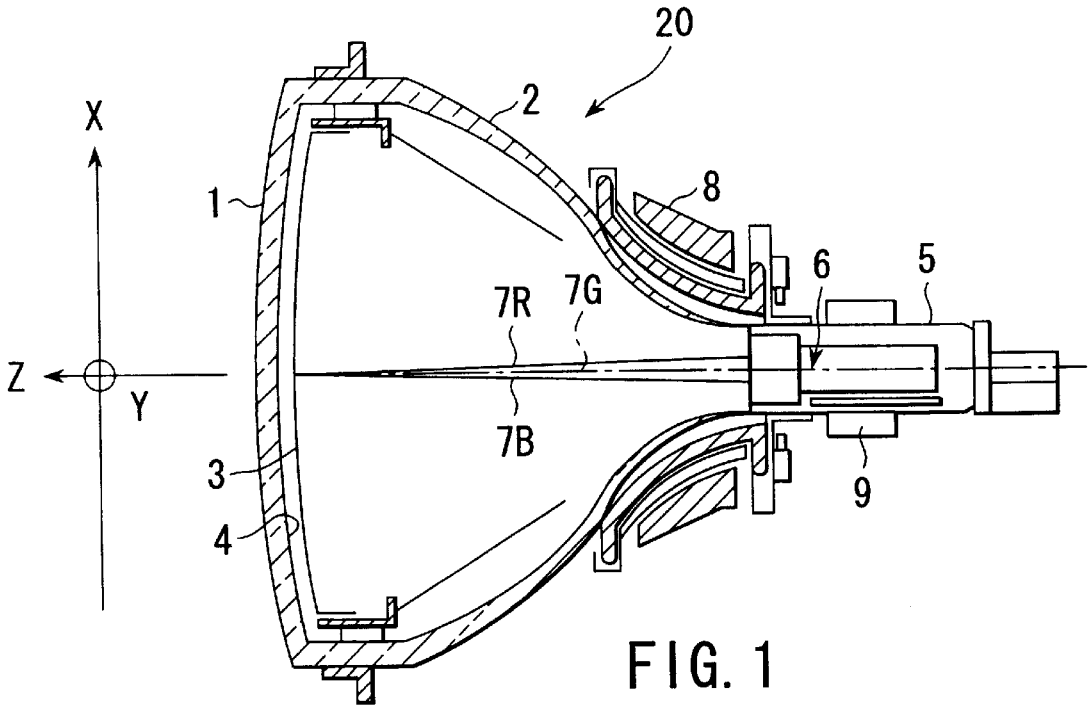
FIG. 1 is a horizontal sectional view of a cathode ray tube apparatus equipped with an electron gun assembly according to the invention.

Referring now to FIG. 1, there is illustrated a cathode ray tube apparatus (e.g., self-convergence, in-line type color cathode ray tube apparatus), which includes an evacuated glass envelope 20. The envelope 20 has a faceplate 1, a neck 5, and a funnel 2, which are integrally joined. A phosphor screen (target) 4, which is formed on the inside of the faceplate 1, has dots or stripes of red, green and blue phosphors. A shadow mask is disposed to be opposed to the phosphor screen 4 and has a very large number of apertures that allow passage of electron beams on its inside.

An in-line electron gun assembly 6 is mounted in the neck 5 and has emits three in-line electron beams: a center beam 7G and a pair of side beams 7R and 7B.

A deflection yoke 8 is mounted on the outside of the funnel 2. The deflection yoke 8 generates non-uniform deflection magnetic fields that deflect the three electron beams 7R, 7G and 7B in the horizontal direction (X) and the vertical direction (Y). The non-uniform deflection magnetic fields comprises a pincushion-shaped horizontal deflection magnetic field and a barrel-shaped vertical deflection magnetic field.

The cathode ray tube apparatus is equipped with a pair of velocity modulation coils 9 externally mounted around the neck 5 behind the deflection yoke 8. The paired velocity modulation coils 9 are arranged so that they are opposed to each other along the horizontal direction X as shown in FIG. 1.

The three electron beams 7R, 7G and 7B emitted from the electron gun assembly 6 are deflected by the non-uniform deflection magnetic fields produced by the deflection yoke 8 to scan across the phosphor screen 4 in the horizontal and vertical directions through the shadow mask 3. Thereby, a color image is produced on the screen.

Figure 2:
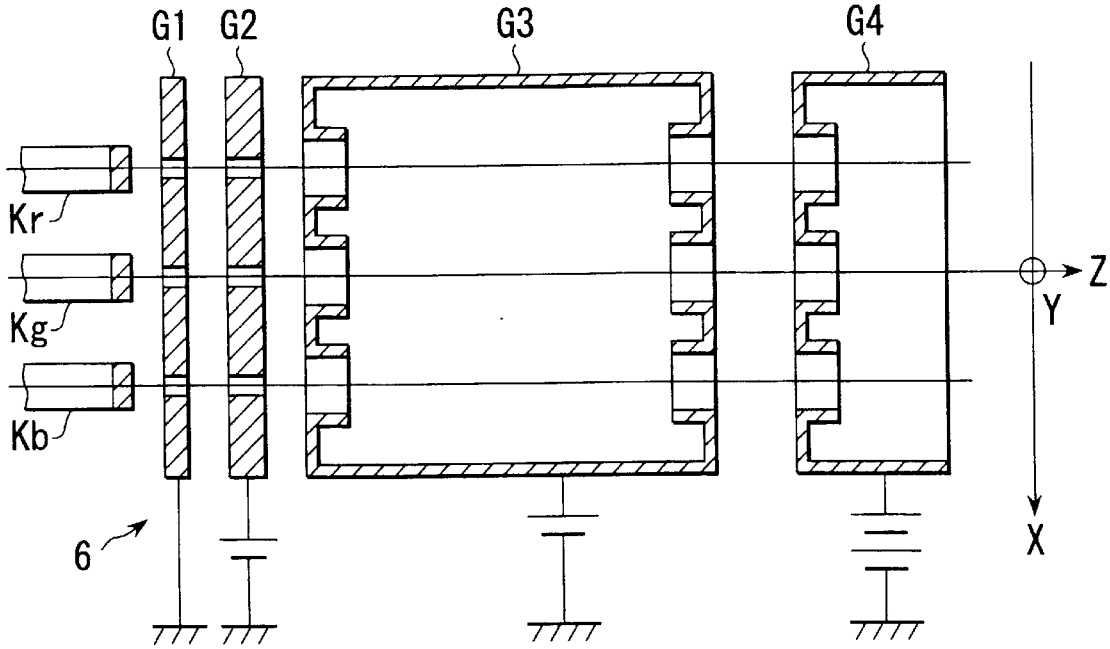
FIG. 2 is a diagrammatic horizontal sectional view of the electron gun assembly according to an embodiment of the invention.

As shown in FIG. 2, the electron gun assembly 6 has three cathodes Kr, Kg and Kb (collectively referred to as cathodes K) arranged in a line in the horizontal direction X, three heaters for heating these cathodes separately, and at least four grids.

The four grids, i.e., the first grid G1, the second grid G2, the third grid G3, and the fourth grid G4, are arranged in this order along the direction of the tube axis (Z) from the cathodes K toward the phosphor screen 4. The heaters, the cathodes and the grids are fixed integrally by means of a pair of insulating supports not shown.

The first and second grids G1 and G2 are each made of a plate-like electrode. These electrodes each have three horizontally aligned circular electron beam passage holes formed in correspondence with the three cathodes to allow electron beams to pass through. The third grid G3, functioning as a focusing electrode, is made of a cylindrical electrode, which is formed at both end surfaces with three horizontally aligned electron-beam passage holes corresponding to the three cathodes. The fourth grid G4, acting as an anode electrode, is made of a cup-like electrode, which is formed in its surface opposite the third grid G3 with three horizontally aligned electron-beam passage holes corresponding to the three cathodes.

In the electron gun assembly thus constructed, the cathodes K are each supplied with a direct-current voltage of the order of 100 to 200 V and a modulation signal corresponding to a video signal. The first grid G1 is connected to ground. The second grid G2 is supplied with a DC voltage in the range of 500 to 1000 V. The third grid G3 is supplied with a focusing voltage (Vf) of the order of 6 to 10 kV. The fourth grid G4 is supplied with an anode voltage in the range of 22 to 35 kV.

The cathodes K, the first grid G1 and the second grid G2 produce electron beams and construct an electron beam generating section that forms an object point relative to the main lens which will be described later. The second and third grids G2 and G3 form a pre-focusing lens for pre-focusing of electron beams from the electron beam generating section. The third and fourth grids G3 and G4 form the main lens that causes each of the pre-focused electron beams to focus onto the phosphor screen.

Figure 3:
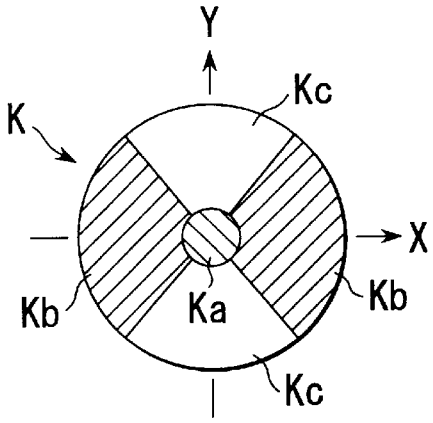
FIG. 3 shows an arrangement of electron emission regions on the cathode surface in the electron gun assembly shown in FIG. 2.

The cathodes K each have at least three regions having different electron emitting capabilities on their surface. That is, as shown in FIG. 3, the cathode surface has three regions: the central portion Ka as the first region, right and left portions Kb as the second region, and upper and lower portions Kc as the third region.

The central portion Ka is formed in the shape of a circle in the center of the cathode surface. The center of the central portion Ka is aligned with the center of the electron beam passage hole formed in the shape of a circle in the first grid G1. The paired right and left portions Kb are arranged along the horizontal direction so that the central portion Ka is put therebetween. The paired right and left portions Kb are formed to be symmetrical with respect to the axis (X axis) parallel to the horizontal direction and the axis (Y axis) parallel to the vertical direction perpendicular to the horizontal direction. The paired upper and lower portions Kc are arranged along the vertical direction so that the central portion Ka is put therebetween. The paired upper and lower portions Kc are formed to be symmetrical with respect to the X axis and the Y axis.

A specific structure of the cathodes K will be described next. In this embodiment, the central portion Ka is made of an M-type impregnated cathode, the right and left portions Kb are made of a top-layer scandate cathode, and the upper and lower portions Kc are made of an S-type impregnated cathode.

The S-type impregnated cathode is a cathode obtained by baking a powder of tungsten (W) having an average grain size of 3 to 5 $\mu$m at a high temperature so that the pore rate becomes about 20% and then melt-impregnating electron emitting substances of barium oxide (BaO), calcium oxide (CaO) and aluminum oxide ($Al_2O_3$) into the pores. The molar composition ratio of the electron emitting substances in the S-type impregnated cathode is $BaO:CaO:Al_2O_3$= 4:1:1.

The M-type impregnated cathode is formed by, for example, sputter depositing a platinum group element, such as iridium (Ir), osmium (Os), ruthenium (Ru), or rhenium (Re), onto the surface of the S-type impregnated cathode. In this embodiment, iridium is coated to a thickness of 150 mm.

The top-layer scandate cathode is formed by, for example, sputter depositing scandium oxide, i.e., scandate ($Sc_2O_3$), and tungsten (W) onto the surface of the S-type impregnated cathode. In this embodiment, tungsten is first sputtered onto the S-type impregnated cathode at a thickness of 8 nm and then scandium oxide is sputtered at a thickness of 2 nm.

Figure 14:
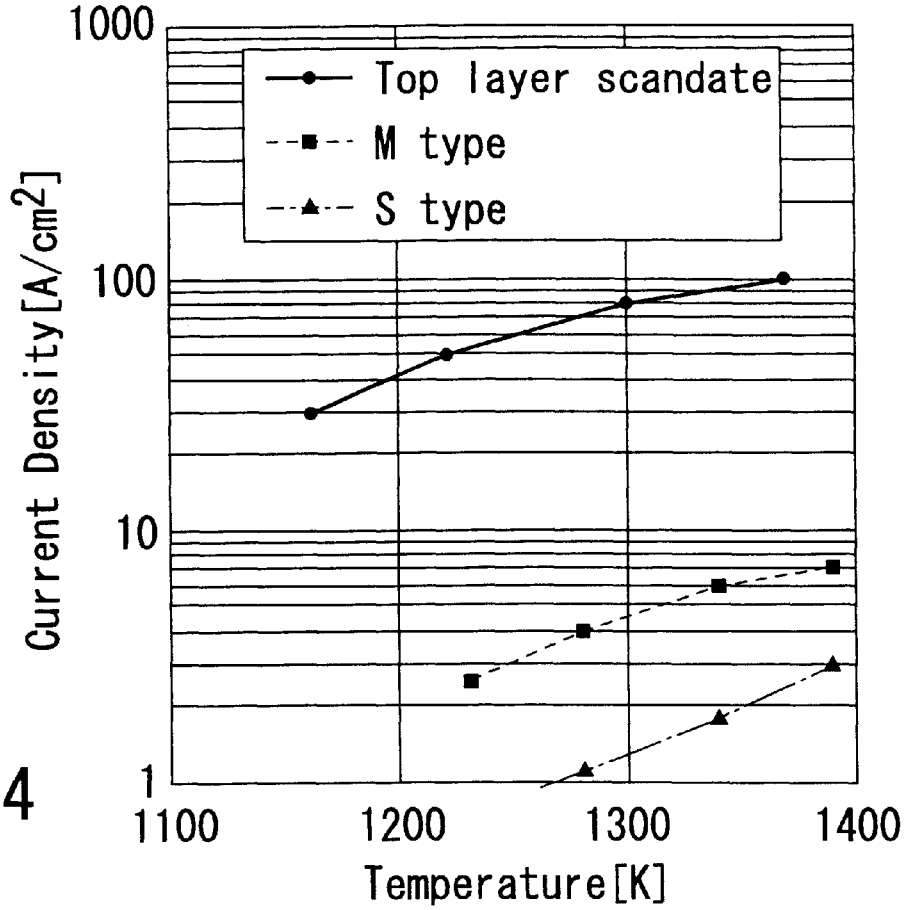
FIG. 14 shows electron emission characteristics of three types of cathodes (top-layer scandate cathode, M-type impregnated cathode, and S-type impregnated cathode)

FIG. 14 shows evaluations of the cathode regions for their electron emission capability. The electron emission capability was measured by applying a pulse voltage of 300 V between the cathode of 1.1 mm in diameter and the anode made of tantalum. The pulse duration was 5 $\mu$sec and the frequency was 50 Hz. The electron emission capability at 1300 K was 2.3 A/cm$^2$ for the S type, 5.3 A/cm$^2$ for the M type, and 50 A/cm$^2$ for the top layer scandate.

In the ability to emit electrons, therefore, the top-layer scandate cathode region (the second region) Kb ranks the highest, the M-type impregnated cathode region (the first region) Ka second, and the S-type impregnated cathode region (the third region) Kc third.

The electron emission capability of each cathode region, while it can be estimated from analysis of components in the region, can also be measured by equipment, for example, Emission Profiler (the trade name of Tokyo cathode institute). It is desirable here that the electron emitting capability be 20 to 100 A/cm$^2$ for the high electron emission region, 3.5 to 10 A/cm$^2$ for the medium electron emission region, and 0 to 3 A/cm$^2$ for the low electron emission region.

Figure 15:
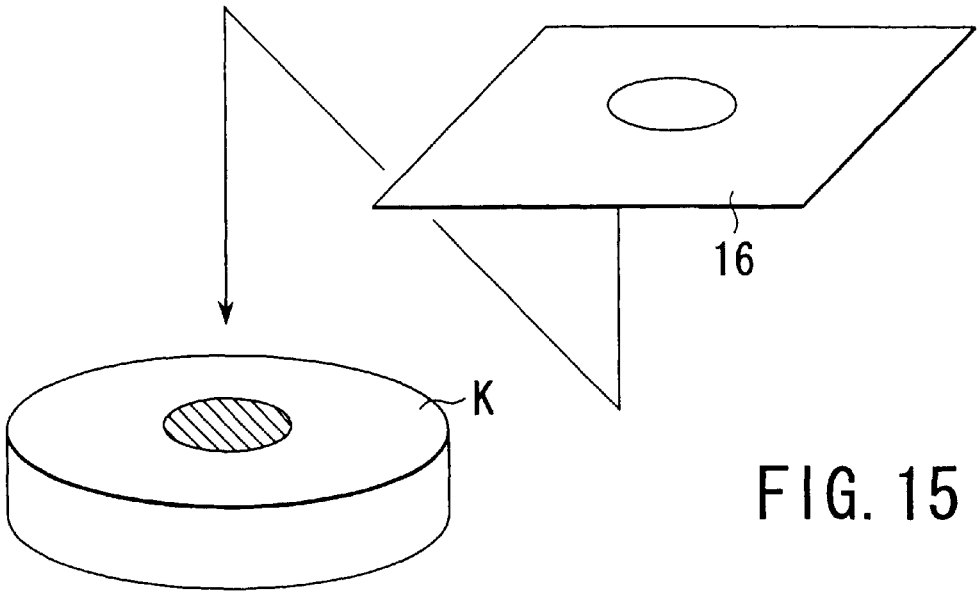
FIG. 15 shows a mask used in forming the first region in the cathode shown in FIG. 3.
Figure 16:
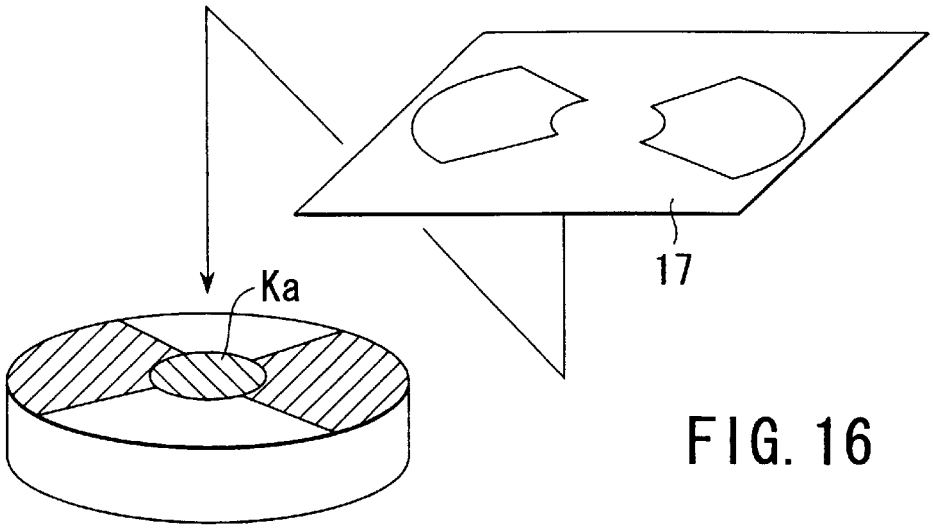
FIG. 16 shows a mask used in forming the second region in the cathode shown in FIG. 3.

The three cathode regions as shown in FIG. 3 are formed in the following way:

First, a circular-shaped S-type impregnated cathode is manufactured by the standard method to prepare a tungsten-based base material. Then, as shown in FIG. 15, iridium is sputter-deposited into the shape of a circle on the central region of the S-type impregnated cathode through the use of a mask 16, forming the first region (the central portion) Ka. Finally, as shown in FIG. 16, tungsten is sputter-deposited onto the areas shaped like butterfly wings around the first region to a thickness of 8 nm and then scandium oxide is deposited to a thickness of 2 nm, forming the second region (the right and left portions) Kb. That region of the base material which is not deposited with iridium and scandium oxide forms the third region Kc.

With the cathode thus constructed, when the current is low, electrons are emitted only from the central region Ka. When the current is high, electrons are emitted from the three regions Ka, Kb and Kc.

The construction provides the following functions.

When the beam current is low, electrons are emitted from the central region Ka which is inferior to the right and left portions Kb in electron emitting capability. Thus, by making the electron emitting capability of the central portion Ka of the cathode surface low, the electron emitting region is made larger than when the entire cathode surface is made to have the same electron emitting capability as the right and left portions Kb.

Figure 6:
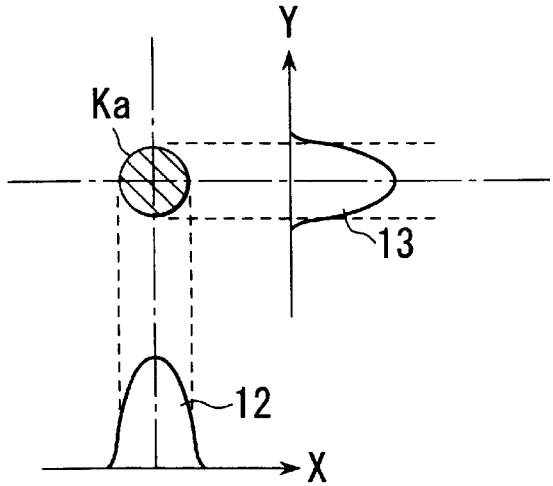
FIG. 6 shows current density profiles at low beam currents in the horizontal and vertical directions in the cathode shown in FIG. 3.
Figure 8:
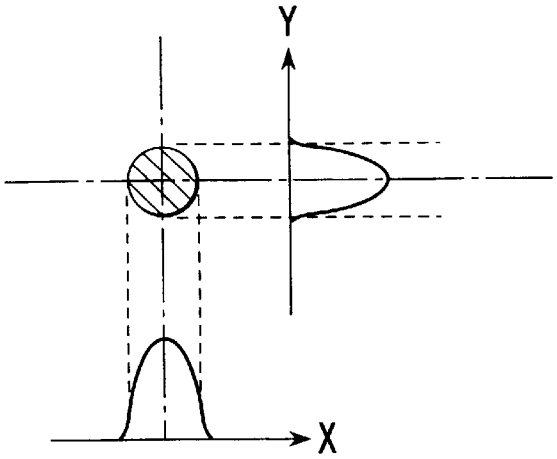
FIG. 8 (PRIOR ART)
FIG. 8 shows current density profiles at low beam currents in the horizontal and vertical directions in a conventional cathode.

As shown in FIG. 6, when the current is low, the electron emitting region Ka on the cathode surface has a current density profile 12 in the horizontal direction X and a current density profile 13 in the vertical direction Y. The electron emitting region Ka in FIG. 6 is larger than in a conventional cathode as shown in FIG. 8.

Figures 10A, 10B:
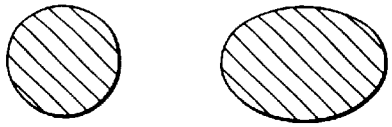
FIG. 10A is a schematic representation of the shape of a beam spot at low beam currents in the cathode shown in FIG. 3.
FIG. 10B is a schematic representation of the shape of a beam spot at high beam currents in the cathode shown in FIG. 3.

Thus, the size of the virtual object point relative to the main lens becomes large. For this reason, as shown in FIG. 10A, the spot size on the phosphor screen at low beam currents is made larger than in the conventional electron gun assembly shown in FIG. 12A. The enlargement of the size of the virtual object point at low beam currents allows the occurrence of moire to be prevented and a change in the spot size to be made small when the current changes from a low value to a high value.

When the beam current is high, on the other hand, electrons are emitted from the three regions Ka, Kb and Kc which have different electron emitting capabilities. Strictly speaking, when the current is high, electrons are emitted mainly from the regions Ka and Kb and the emission of electrons from the region Kc is controlled. Thus, the number of electrons emitted from the cathode surface along the horizontal direction differs from that along the vertical direction.

Figure 7:
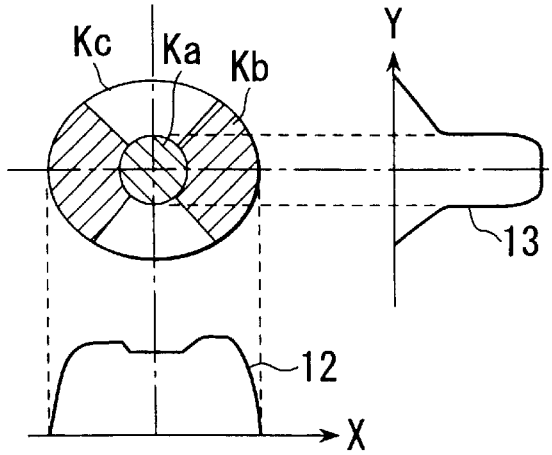
FIG. 7 shows current density profiles at high beam currents in the horizontal and vertical directions in the cathode shown in FIG. 3.
Figure 9:
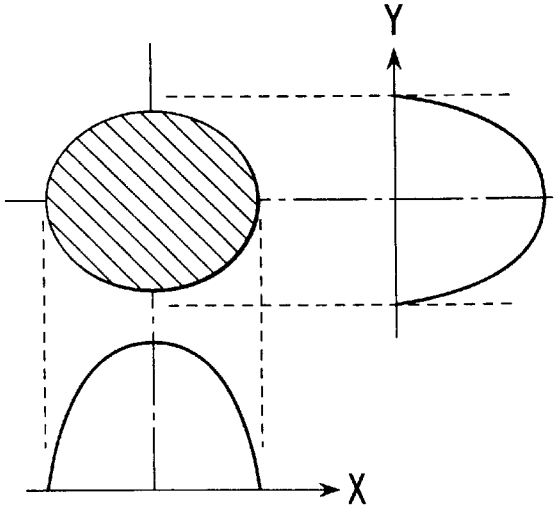
FIG. 9 (PRIOR ART)
FIG. 9 shows current density profiles at high beam currents in the horizontal and vertical directions in the conventional cathode.

That is, as shown in FIG. 7, when the beam current is high, the electron emitting regions (Ka+Kb) on the cathode surface have a current density profile 12 with respect to the horizontal direction X and a current density profile 13 with respect to the vertical direction Y, which are different in shape. The electron emitting regions (Ka+Kb) when the current is high as shown in FIG. 7 are smaller in the amount of current in the vertical direction X and the horizontal direction Y than the electron emitting region of the conventional cathode as shown in FIG. 9. Particularly, in the electron emitting regions (Ka+Kb) of this embodiment, as shown in FIG. 7, the amount of current in the vertical direction Y is smaller than in the horizontal direction X.

Thus, an increase in the vertical direction of the size of the virtual object point relative to the main lens can be minimized. The space charges repelling effect can be weakened, which controls an increase in the vertical direction of the size of the virtual object point and the movement of the virtual object point toward the phosphor screen to smaller than in the case of the conventional cathode. As a result, an increase in the vertical direction of the spot size on the phosphor screen can be minimized as shown in FIG. 10B in comparison with the spot size in the conventional electron gun assembly as shown in FIG. 12B.

In this case, since sufficient electrons are emitted from the right and left portions Kb with the highest electron emitting capability, an increase in the drive voltage required to obtain a cathode current can be minimized.

When the current is low, the virtual object point can be made larger in size than in the conventional cathode. When the current changes from a low value to a high value, the size of the virtual object point in the vertical direction can be kept from increasing and the forward movement of the virtual object point can be made less than in the conventional cathode. Thus, the spot size can be kept from increasing and an increase in the drive voltage can be minimized.

Figures 11A, 11B:
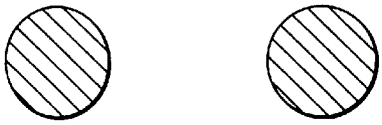
FIG. 11A is a schematic representation of the shape of a beam spot at low beam currents in the cathode shown in FIG. 3 when the velocity modulation coil is operated.
FIG. 11B is a schematic representation of the shape of a beam spot at high beam currents in the cathode shown in FIG. 3 when the velocity modulation coil is operated.

Note that, with the electron gun assembly of this embodiment, the size of the beam spot in the horizontal direction on the phosphor screen becomes slightly larger than heretofore. However, the size of the beam spot in the horizontal direction can be restrained from increasing by the velocity modulation coil 9. That is, as shown in FIGS. 11A and 11B, driving the velocity modulation coil 9 allows the beam spot size in the horizontal direction to be made small in comparison with the spot size shown in FIGS. 10A and 10B. Thus, the difference between the beam spot size in the horizontal direction at high beam currents and that at low beam currents can be made small.

Figure 12A:
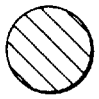
FIG. 12A (PRIOR ART)
FIG. 12A is a schematic representation of the shape of a beam spot at low beam currents in the conventional cathode.
Figure 12B:
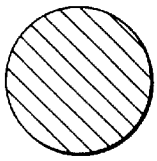
FIG. 12B (PRIOR ART)
FIG. 12B is a schematic representation of the shape of a beam spot at high beam currents in the conventional cathode.
Figure 13A:
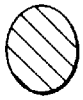
FIG. 13A (PRIOR ART)
FIG. 13A is a schematic representation of the shape of a beam spot at low beam currents in the conventional cathode when the velocity modulation coil is operated.
Figure 13B:
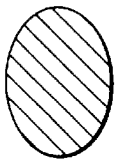
FIG. 13B (PRIOR ART)
FIG. 13B is a schematic representation of the shape of a beam spot at high beam currents in the conventional cathode when the velocity modulation coil is operated.

In contrast, with the conventional gun assembly, the use of the velocity modulation coil causes the spot size in the horizontal direction to become excessively small particularly at high beam currents as shown in FIGS. 13A and 13B, in comparison with the beam spot size shown in FIGS. 12A and 12B. The beam spot shape is thus degraded.

Accordingly, an electron gun assembly for a cathode ray tube can be provided which can achieve high definition over a wide range of beam currents simply by forming three regions with different electron emission capabilities on the cathode surface without changing the arrangement of the gun assembly and significantly increasing the burden on the drive circuitry.

Another embodiment of the present invention will be described next.

In this embodiment, the first grid G1, which is a constituent of the electron beam generating section, is formed with openings for correcting electric fields produced by the electron beam generating section in addition to the three electron beam passage holes.

Figure 17:
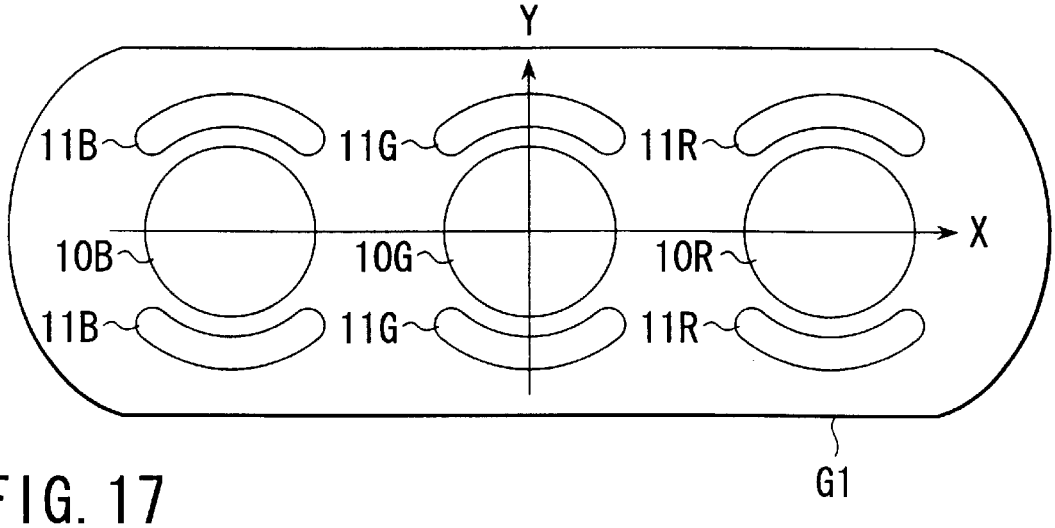
FIGS. 17 and 18 are diagrammatic plan views of the first grid in the electron gun assembly shown in FIG. 2 according to another embodiment of the invention.

That is, as shown in FIG. 17, the first grid G1 has three pairs of openings 11R, 11G and 11B (collectively referred to as openings 11) through which electrons do not pass in correspondence with the three electron beam passage holes 10R, 10G and 10B (collectively referred to as the holes 10), each pair of openings 11 being formed above and below a corresponding one of the three holes 10. The paired openings 11 are formed to be symmetrical with respect to both the horizontal axis X parallel to the line passing through the centers of the holes 10 and the vertical axis Y.

Figure 19:
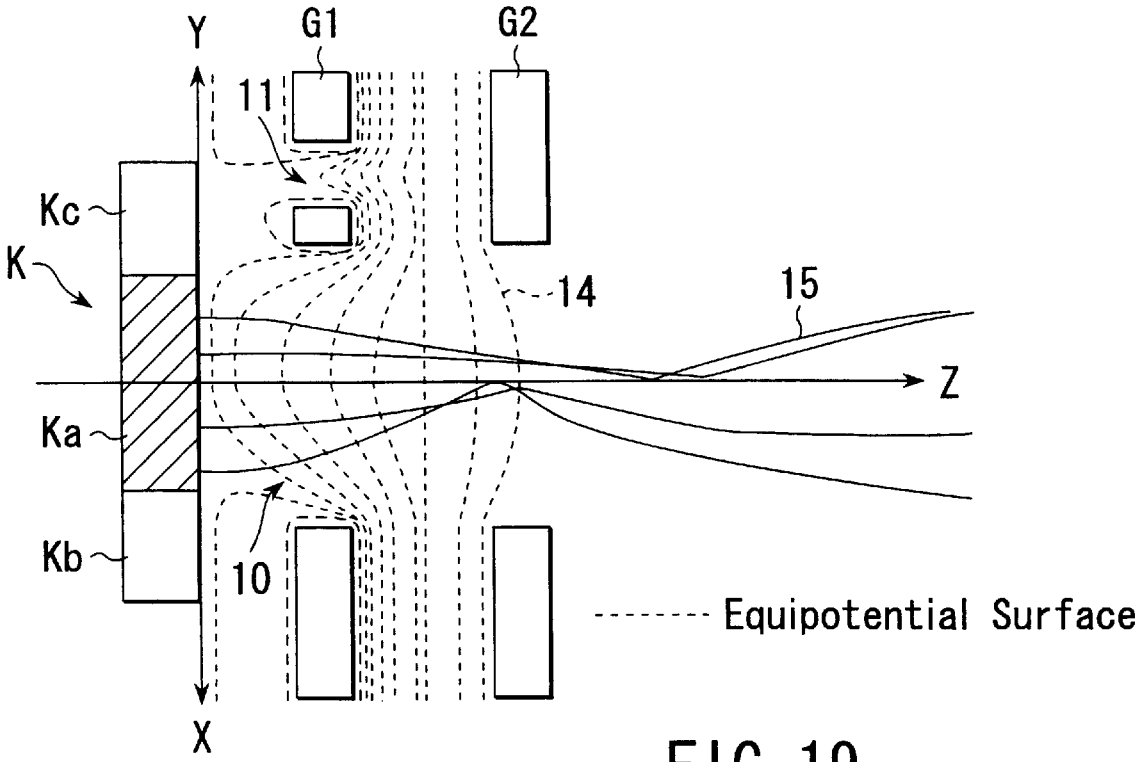
FIG. 19 is a diagram illustrating the shape of electric fields produced by the electron generating device and a beam of electrons emitted from the cathode having three regions with different electron emission capabilities when the cathode is combined with the first grid formed with openings for electric field correction.
Figure 21:
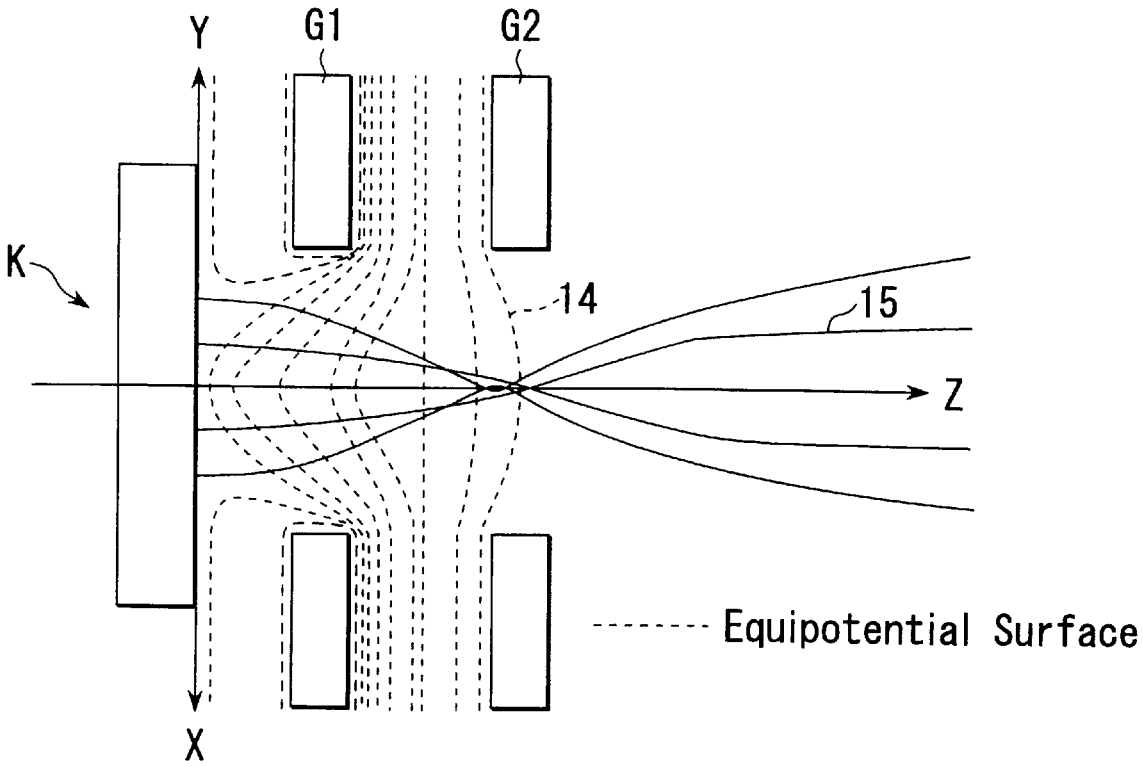
FIG. 21 (PRIOR ART)
FIG. 21 is a diagram illustrating the shape of electric fields produced by the electron generating device and a beam of electrons emitted from the conventional cathode when the cathode is combined with the first grid.

By forming the openings 11 in the first grid G1, the electron beam generating section consisting of the cathode K, the first grid G1 and the second grid G2 forms such shapes of electric fields (equipotential surfaces) as shown in FIG. 19. The openings 11 affect the shapes of the electric fields between the cathode K and the first grid G1, but they are of such size that electron beams do not pass through. As a result, in comparison with the conventional electron beam generating section as shown in FIG. 21, the gradient of electric fields can be made gentle, i.e., parallel to the cathode surface over a fixed distance from the center of the cathode in the vertical direction.

Figure 20:
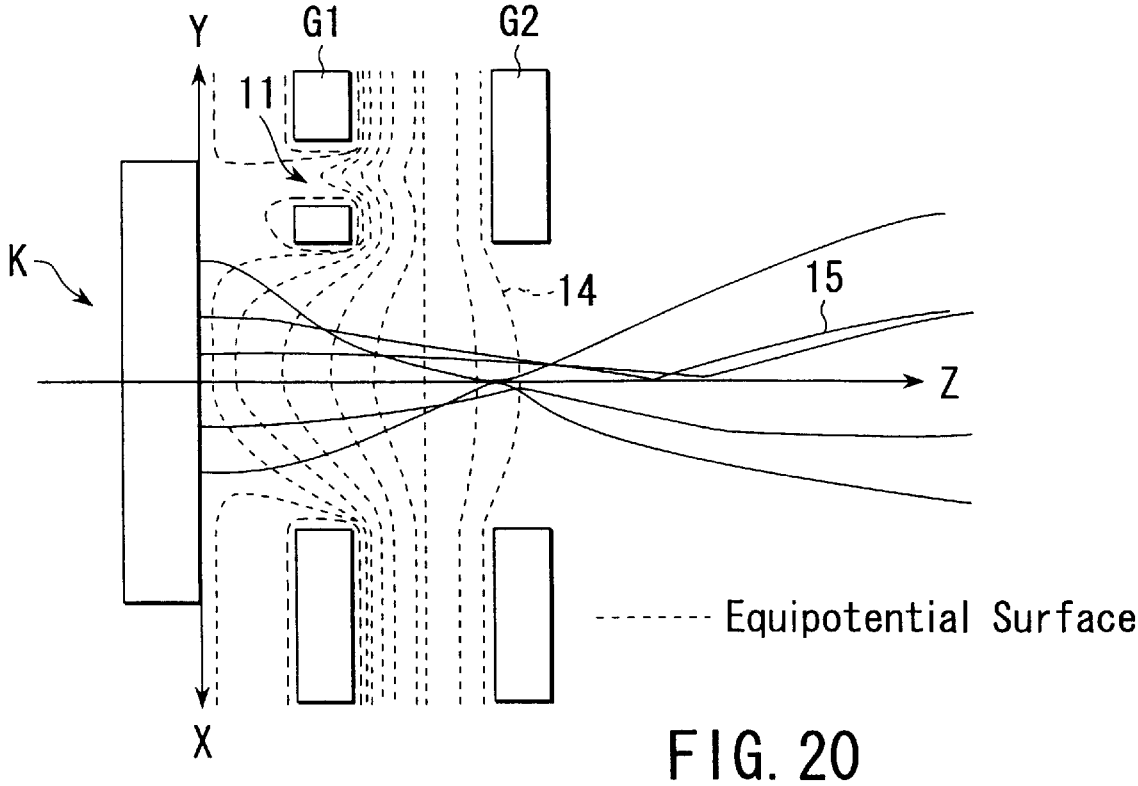
FIG. 20 is a diagram illustrating the shape of electric fields produced by the electron generating device and a beam of electrons emitted from the cathode having three regions with different electron emission capabilities when the cathode is combined with the conventional first grid.

On the other hand, as shown in FIG. 20, the combined use of the first grid G1 of this embodiment and the conventional cathode with a uniform electron emission capability makes the gradient of equipotential surfaces in the vicinity of outer ends of the electron emitting region more abrupt than that of conventional equipotential surfaces shown in FIG. 19. This causes the trajectory of outermost electrons in the electron beam 15 to be deviated greatly with respect to the center trajectory as shown in FIG. 20, causing the spot size to vary.

For this reason, the first grid G1 having the openings 11 in addition to the electron beam passage holes 10 is combined with the cathode K having three electron emitting regions. By so doing, the gradient of the equipotential surfaces 14 at large beam currents can be made gentle through the difference in electron emission capability between the first and third regions Ka and Kc, thus allowing the emission of electrons from the outermost regions to be controlled.

Thus, by controlling the emission of electrons from the outermost regions in the vertical direction when the beam current reaches a certain value, changes in the crossover point position and the angle of divergence can be controlled when the beam current changes from a low value to a high value. That is, the difference between the optimum focus voltage at high beam currents and that at low beam currents can be made small.

By allowing the second region Kb of the cathode K to have the highest electron emission capability among the three electron emission regions, extreme enlargement of the electron emitting region in the horizontal direction can be suppressed.

By the above arrangement, as shown in FIG. 19, the crossover position in the horizontal direction X and the crossover position in the vertical direction Y are made different from each other. This lessens the space charge repelling effect, allowing the electron beam diameter at high beam currents to be kept from increasing.

By setting the electron emission capability of the first region Ka lower than that of the second region Kb, the electron emitting region at low beam currents can be made larger than when the entire cathode has the same electron emission capability as the second region Kb, increasing the beam spot size on the phosphor screen. Thus, the moire can be reduced.

With the cathode surface constructed as described above, an electron beam is emitted mainly from the central region Ka when the beam current is low. On the other hand, when the beam current is high, an electron beam is emitted mainly from the two regions Ka and Kb and the emission of electrons from the region Kc is controlled.

When the beam current is low, electrons are emitted from the central portion Ka which is lower in electron emission capability than the right and left portions Kb. Thus, by setting low the electron emission capability of the central portion Ka of the cathode surface, the electron emitting region can be made larger than when the entire cathode surface is set to have the same electron emission capability as the right and left portions Kb.

Figure 22:
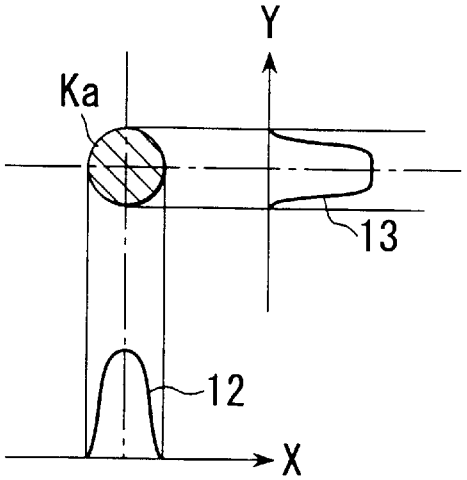
FIG. 22 shows current density profiles at low beam currents in the horizontal and vertical directions in the cathode shown in FIG. 3.

As shown in FIG. 22, when the beam current is low, the electron emitting region Ka in the cathode surface has a current density profile 12 in the horizontal direction X and a current density profile 13 in the vertical direction Y. The electron emitting region Ka at low beam currents shown in FIG. 14 becomes larger than the electron emitting region of the conventional cathode as shown in FIG. 8.

For this reason, the size of the virtual object point relative to the main lens is increased, which allows the spot size on the phosphor screen at low beam currents to become large in comparison with that in the conventional electron gun assembly. An increase in the size of the virtual object point at low beam currents prevents the occurrence of moire and allows a variation in the spot size with increasing beam current to be reduced.

At high beam currents, electrons are emitted from the two electron emitting regions Ka and Kb and the emission of electrons from the region Kc is controlled. Therefore, the number of electrons emitted from the cathode surface in the horizontal direction and that in the vertical direction differ from each other.

Figure 23:
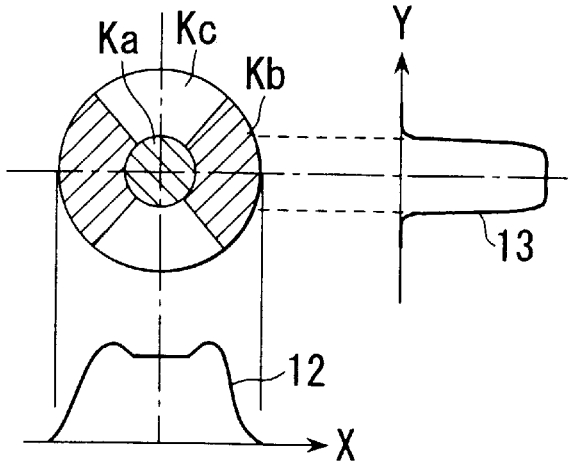
FIG. 23 shows current density profiles at high beam currents in the horizontal and vertical directions in the cathode shown in FIG. 3.

That is, as shown in FIG. 23, the electron emitting regions (Ka+Kb) at high beam currents have a current density profile 12 in the horizontal direction X and a current density profile 13 in the vertical direction, which differ in shape. At large beam currents, in the electron emitting regions (Ka+Kb) as shown in FIG. 23, the current amount in the vertical and horizontal directions is smaller than in the electron emitting region of the conventional cathode as shown in FIG. 9. Particularly in the electron emitting regions as shown in FIG. 23, the amount of current in the vertical direction Y is smaller than in the horizontal direction X.

This allows an increase in the vertical direction in the size of the virtual object point relative to the main lens to be made less than with conventional cathode. Also, the space charge repelling effect is lessened, allowing an increase in the size of the virtual object point in the vertical direction and the movement of the object point toward the phosphor screen to be made less than with the conventional cathode. As a result, an increase in the vertical direction in the spot size on the phosphor screen at high beam currents can be made less than with the conventional electron gun assembly.

In this case, since sufficient electrons are emitted from the right and left cathode portions Kb highest in the electron emission capability, a minimum increase in the drive voltage is required to obtain cathode currents.

Thus, by constructing the cathode as described above, the size of the virtual object point at low beam currents can be made larger than with the conventional cathode, the size of the virtual object point in the vertical direction at high beam currents can be kept from increasing, and the distance moved by the virtual object point can be made smaller than with the conventional cathode. Therefore, the spot size can be kept from increasing. Also, an increase in the magnitude of the drive voltage can be made small.

With the electron gun assembly of this embodiment, the size of the beam spot in the horizontal direction on the phosphor screen becomes somewhat larger than conventional. However, as in the previously described embodiment, an increase in the beam spot in the horizontal direction can be controlled by the velocity modulation coil 9, which allows the difference in beam spot size in the horizontal direction to be reduced.

By forming the cathode surface with three regions having different electron emission capabilities and forming the first grid G1 with a pair of openings above and below each of the electron beam passage holes, the following advantages are provided:

(1) A change in the optimum focusing voltage for beam spots in the vertical direction on the phosphor screen with respect to a change in beam current can be controlled to minimize an increase in the beam spot size on the phosphor screen due to the change in the optimum focusing voltage.

(2) The occurrence of moire at low beam currents can be controlled.

(3) By displacing the crossover points in the horizontal and vertical directions from each other, the space charge repelling effect can be lessened and hence the spot size can be reduced in its entirety.

Thus, an electron gun assembly for a cathode ray tube can be provided which allows high definition to be reserved with little degradation in picture quality over a wide range of beam current without considerably increasing the burden on the driving circuitry.

Although the embodiments of the present invention have been disclosed and described, it is apparent that other embodiments and modifications are possible. For example, the main lens has been described as being of the bipotential type made from the third and fourth electrodes, a unipotential type, a quadrapotential type or other composite type may be used.

Although, in the above embodiments, the boundary between each electron emitting region is defined clearly, the regions may be formed such that their electron emission capability varies gently at the boundary.

The number of the electron emitting regions on the cathode surface may be more than three. The three electron emitting regions may be arranged as shown in FIG. 4 or 5.

Figure 4:
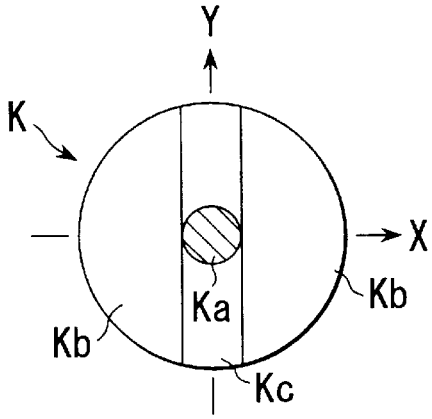
FIG. 4 shows another arrangement of electron emission regions on the cathode surface in the electron gun assembly shown in FIG. 2.

In the arrangement of FIG. 4, the right and left portions Kb highest in the electron emission capability are formed substantially in the shape of a semicircle on opposite sides of the circular, central portion Ka next highest in the electron emission capability in the horizontal direction X. The upper and lower portions Kc lowest in the electron emission capability are formed substantially in the shape of a stripe on opposite sides of the central portion Ka in the vertical direction Y.

Figure 5:
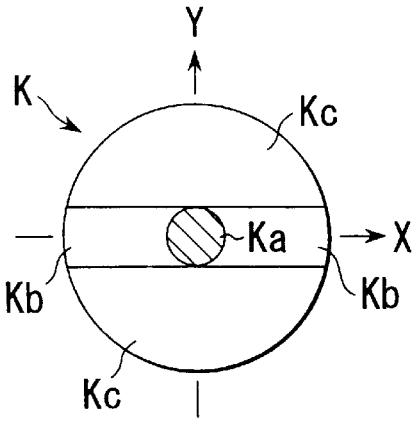
FIG. 5 shows still another arrangement of electron emission regions on the cathode surface in the electron gun assembly shown in FIG. 2.

In the arrangement of FIG. 5, the right and left portions Kb are formed substantially in the shape of a semicircle on opposite sides of the circular, central portion Ka in the vertical direction. The upper and lower portions Kc are formed substantially in the shape of a stripe on opposite sides of the central portion Ka in the horizontal direction.

As in the above embodiments, the arrangements of the electron emission regions as shown in FIGS. 4 and 5 allow the beam spot size on the phosphor screen at low beam currents to be increased and an increase in the beam spot size in the vertical direction at high beam currents to be controlled.

Figure 18:
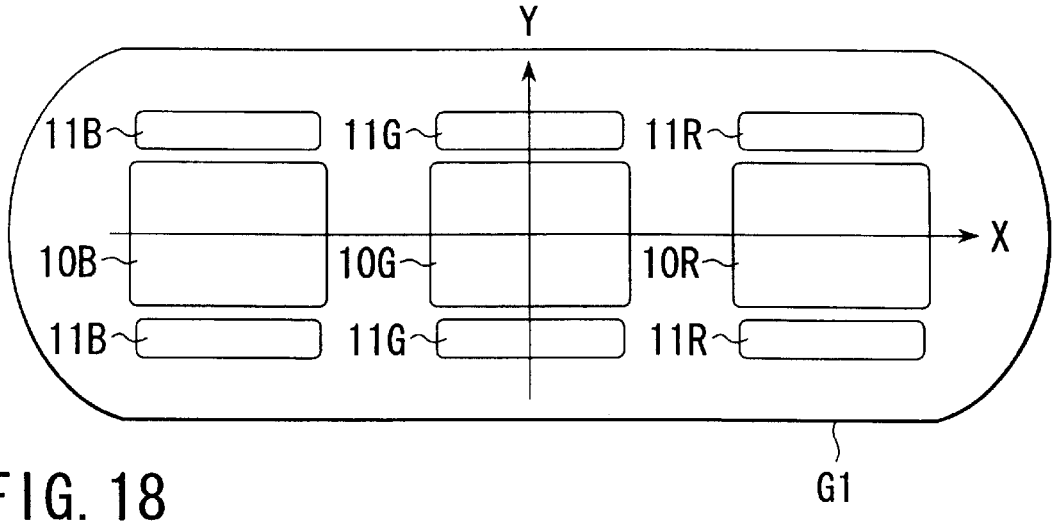

In the aforementioned second embodiment, although the electron passage holes formed in the first grid G1 are circular in shape and the electric field correcting openings are elliptic in shape as shown in FIG. 17, they may be formed in any other shape. For example, as shown in FIG. 18, the electron beam passage holes 10 may be formed in the shape of a square or rectangle. In this case, the openings 11 are formed to conform to the shape of the holes 10.

According to the present invention, as described above, an electron gun assembly and a cathode ray tube equipped with the gun assembly can be provided which allow an increase in the burden on drive circuitry to be controlled, an increase in the beam spot size in the horizontal and vertical directions on the phosphor screen with increasing beam current to be controlled, and high definition to be obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electron gun assembly comprising:

an electron beam generating section which generates an electron beam; and a main lens which accelerates the electron beam and focuses it onto a target, wherein the electron beam generating section includes a cathode having an electron emitting surface and the surface of the cathode is divided into at least three regions of first, second and third regions which are different in electron emission capability, the first region being arranged in the center of the surface of the cathode, the second region being arranged on opposite sides of the first region in a first direction, and the third region being arranged on opposite sides of the first region in a second direction, and wherein at least one of the second and third regions includes two or more discrete portions.

2. The electron gun assembly according to claim 1, wherein the first direction is parallel to the horizontal direction and the second direction is parallel to the vertical direction, and wherein, in the electron emission capability, the second region ranks first, the first region ranks second and the third region ranks third.

3. The electron gun assembly according to claim 1, wherein the first, second and third regions have their respective electron emission capability made symmetrical with respect to an axis parallel to the horizontal or vertical direction.

4. The electron gun assembly according to claim 1, wherein the second region is symmetrical with respect to an axis parallel to the horizontal direction and the third region is symmetrical with respect to an axis parallel to the vertical direction.

5. An electron gun assembly comprising:

an electron beam generating section which generates three electron beams arranged in a horizontal direction; and a main lens which accelerates the electron beams and focuses them onto a target, wherein the electron beam generating section includes three cathodes arranged in the horizontal direction and each having an electron emitting surface, a first electrode, and a second electrode, and the surface of each of the cathodes is divided into at least three regions of first, second and third regions which are different in electron emission capability, the first region being arranged in the center of the surface of the cathode, the second region being arranged on opposite sides of the first region in the horizontal direction, and the third region being arranged on opposite sides of the first region in the vertical direction perpendicular to the horizontal direction, and wherein at least one of the second and third regions includes two or more discrete portions.

6. The electron gun assembly according to claim 5, wherein, in the electron emission capability, the second region ranks first, the first region ranks second and the third region ranks third.

7. The electron gun assembly according to claim 5, wherein the first electrode includes three circular holes to allow passage of electron beams in correspondence with the three cathodes, and the first region on the surface of each of the cathodes has a shape of a circle so that its center is aligned with the center of a corresponding one of the three electron beam passage holes in the first electrode.

8. The electron gun assembly according to claim 5, wherein the second region is symmetrical with respect to an axis parallel to the horizontal direction and the third region is symmetrical with respect to an axis parallel to the vertical direction.

9. A cathode ray tube apparatus including an electron gun assembly comprising:

an electron beam generating section which generates three electron beams in a horizontal direction;

a main lens which accelerates the electron beams and focuses them onto a phosphor screen;

a deflection yoke which deflects the three electron beams to scan across the phosphor screen in the horizontal and vertical directions; and a velocity modulation coil which modulates a velocity of the electron beams, wherein the electron beam generating section includes three horizontally aligned cathodes and each having an electron emitting surface, a first electrode, and a second electrode which are arranged in this order in the direction in which the electron beams travel, and the surface of each of the cathodes is divided into at least three regions of first, second and third regions which have different electron emission capabilities, the first region being arranged in the center of the surface of the cathode, the second region being arranged on opposite sides of the first region in the horizontal direction, and the third region being arranged on opposite sides of the first region in the vertical direction, and wherein at least one of the second and third regions includes two or more discrete portions.

10. An electron gun assembly comprising:

an electron beam generating section which generates an electron beam; and a main lens which accelerates the electron beam and focuses it onto a target, wherein the electron beam generating section includes a cathode having an electron emitting surface, a first electrode, and a second electrode which are arranged in this order in the direction in which the electron beam travels, the first electrode including openings for correcting electric fields produced by the electron generating section, and the surface of the cathode is divided into at least three regions of first, second and third regions which have different electron emission capabilities, the first region being arranged in the center of the surface of the cathode, the second region being arranged on opposite sides of the first region in a first direction, and the third region being arranged on opposite sides of the first region in a second direction, and wherein at least one of the second and third regions includes two or more discrete portions.

11. The electron gun assembly according to claim 10, wherein the first electrode includes a hole to allow passage of the electron beam and at least two openings which are arranged on opposite sides of the electron beam passage hole.

12. The electron gun assembly according to claim 11, wherein the openings are arranged in the second direction with the electron beam passage hole therebetween.

13. The electron gun assembly according to claim 12, wherein the openings are arranged symmetrically with respect to an axis parallel to the first direction or the second direction.

14. The electron gun assembly according to claim 10, wherein the first, second and third regions have their respective electron emission capability made symmetrical with respect to an axis parallel to the horizontal or vertical direction.

15. The electron gun assembly according to claim 10, wherein, in the electron emission capability, the second region ranks first, the first region ranks second and the third region ranks third.

16. A cathode ray tube apparatus comprising:

an electron gun assembly having an electron beam generating section which generates three electron beams in a horizontal direction;

a main lens which accelerates the electron beams and focuses them onto a phosphor screen; and a deflection yoke which deflects the three electron beams to scan across the phosphor screen in the horizontal and vertical directions, wherein the electron beam generating section includes three horizontally aligned cathodes and each having an electron emitting surface, a first electrode, and a second electrode which are arranged in this order in the direction in which the electron beams travel, the first electrode is formed with openings for correcting electric fields produced by the electron generating section, and the surface of each of the cathodes is divided into at least three regions of first, second and third regions which have different electron emission capabilities, the first region being arranged in the center of the surface of the cathode, the second region being arranged on opposite sides of the first region in the horizontal direction, and the third region being arranged on opposite sides of the first region in the vertical direction, and wherein at least one of the second the third regions includes two or more discrete portions.

* * * * *